United States Patent [19]

Bennett

[11] 4,018,159

[45] Apr. 19, 1977

[54] AIR FLOW GUIDE MECHANISM

[75] Inventor: George Thomas Bennett, Kettering, Ohio

[73] Assignee: General Motors Corporation, Detroit, Mich.

[22] Filed: Sept. 4, 1975

[21] Appl. No.: 610,405

[52] U.S. Cl. ..... 98/40 VM; 98/94 AC; 98/121 A; 62/262; 49/82; 415/125

[51] Int. Cl.[2] ..... F24F 13/10

[58] Field of Search ..... 98/40 VM, 94 R, 94 AC, 98/121 R, 121 A, 110; 415/125; 62/262; 49/75, 77, 82

[56] References Cited

UNITED STATES PATENTS

| | | | |
|---|---|---|---|
| 3,294,007 | 12/1966 | Gleason et al. | 98/121 A X |
| 3,380,372 | 4/1968 | Perry | 98/121 A |
| 3,472,149 | 10/1969 | Harrison | 98/121 R |
| 3,592,123 | 7/1971 | Henken et al. | 98/94 |
| 3,699,873 | 10/1972 | Irvin | 415/125 |

*Primary Examiner*—Ronald C. Capossela
*Attorney, Agent, or Firm*—D. D. McGraw

[57] ABSTRACT

A room air conditioning unit has an air flow guide mechanism which provides an oscillating-type of air sweep louvered grill for the unit discharge duct. A motor with suitable gear reduction supplies power to a double acting barrel cam having a curved surface matching the radius of the center of rotation of the grill assembly to a point of contact of a follower fixed to the air conditioner unit front cabinet housing. The cam has a groove receiving the follower to transmit the desired amount of movement to rock the guide mechanism about a horizontal axis to provide a vertical air sweep. An eccentric pin on the cam drives a vertical louvered actuating rack to generate horizontal air sweep. The cam follower may be disengaged from the cam groove when vertical air sweep action is not desired.

2 Claims, 5 Drawing Figures

AIR FLOW GUIDE MECHANISM

The invention relates to an air flow guide mechanism and more particularly to such a mechanism adapted for use with room air conditioning units. Such units are usually placed in a window or other wall opening and provide the source of conditioned air for one or two rooms. It is of importance that the air delivered from the unit be distributed effectively through the room while avoiding objectionable drafts on persons occupying the room.

Most room air conditioners are provided with manually adjustable louvers which permit some choice as to the deflection of delivered air in either the horizontal or vertical planes, or both. Some units have been provided in the past with an oscillating louver structure which provides a continuous variation in the direction of the air. The prior units have utilized power driven horizontally oscillating louver sets.

It is an object of this invention to provide improved air flow guide mechanism for room air conditioning units including an arrangement for driving a set of horizontal louvers pivotally while also driving a set of vertical louvers pivotally about vertical axes, utilizing a single motor mechanism and a multi-function cam assembly to provide both such drives. It is another object of the invention to provide for selective driving or omission of the driving function for one set of louvers while continuing to drive the other set of louvers. More particularly, the drive for the horizontal louvers may be discharged when desired, permitting air flow to be deflected in different directions by pivotal action only of the vertical louvers.

IN THE DRAWINGS

Figure 1:
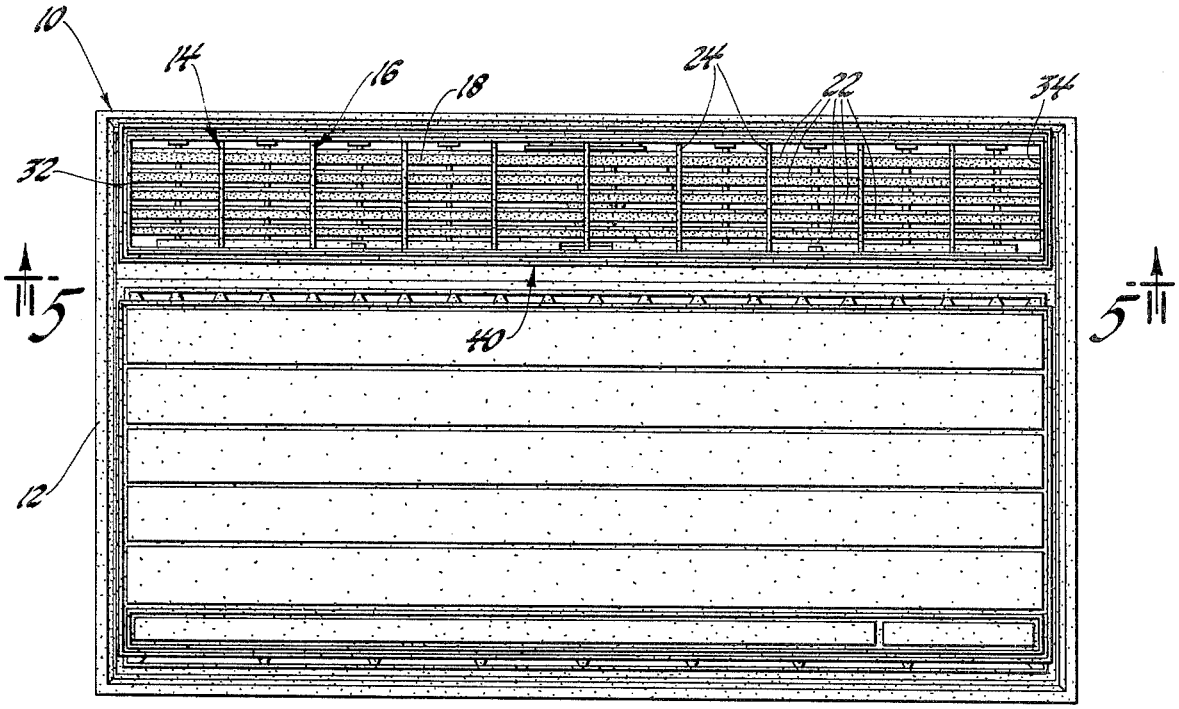
FIG. 1 is a front elevation view of a room air conditioner unit embodying the invention.
Figure 2:
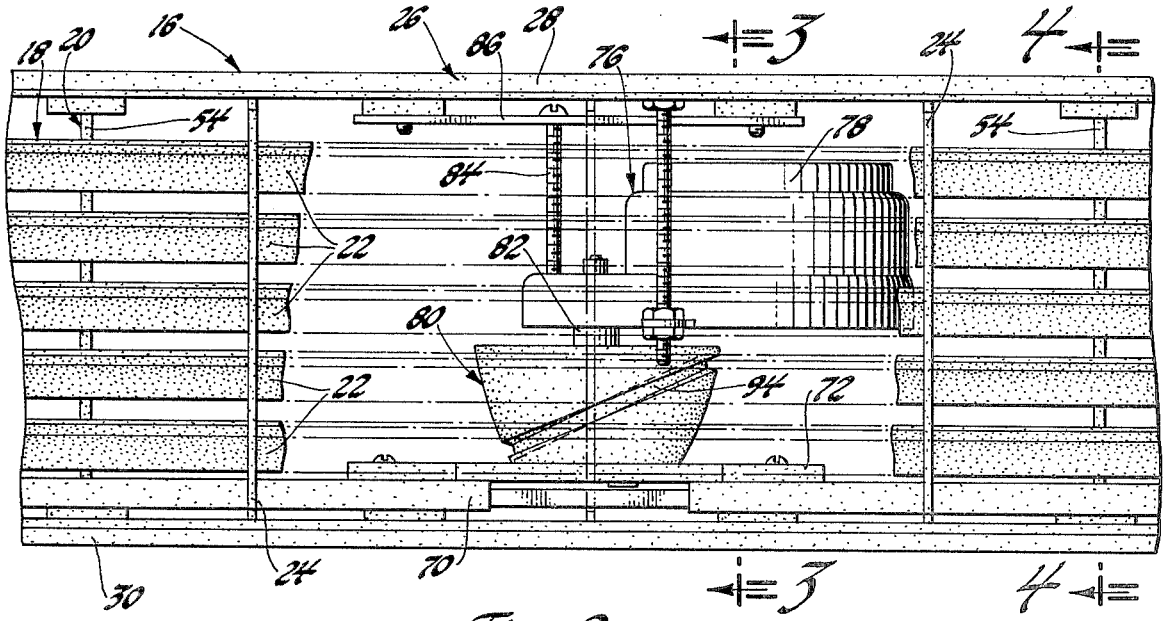
FIG. 2 is an enlarged view of the air flow guide mechanism of FIG. 1, having parts broken away, and particularly illustrating portions of the drive mechanism embodied in the invention.

The room air conditioner unit 10 includes a cabinet 12 and an air flow guide mechanism 14 which delivers air into the room. Mechanism 14 includes a grill assembly 16 composed of a horizontal louver array 18 and a vertical louver array 20. The horizontal louver array includes a series of horizontal louvers 22 mounted on vertically extending support members 24.

The support members are attached at their upper and lower ends to a rack 26 and define therewith rack means which functions as a louver array support. Rack 26 has a top wall 28, a bottom wall 30, and end walls 32 and 34. Each end wall is provided with a pivot 36 lying on the horizontal axis 38 about which the horizontal louver array 18 is to be pivoted.

Figure 3:
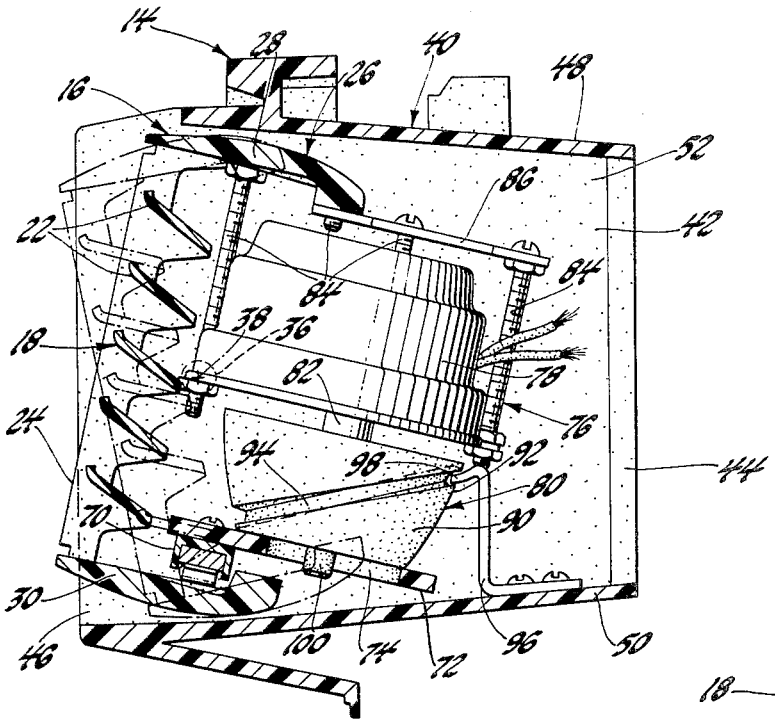
FIG. 3 is a cross-section view taken in the direction of arrows 3—3 of FIG. 2 and illustrating by solid and phantom lines the pivotal action of a louver array about a horizontal axis, and additional details of the mechanism embodying the invention.

The air flow guide mechanism 14 has a housing 40 which is secured in position in cabinet 12 so as to provide an opening 42 with an air entry 44 and an air exit 46. Opening 42 is defined by housing top wall 48, bottom wall 50, and end walls, one such wall 52 being illustrated in FIG. 3. End wall 52 on one end of housing 40 and the end wall on the other end of that housing have pivot-receiving openings in which pivots 36 are mounted so that the entire rack 26 may pivot about horizontal axis 38 within housing 40.

Figure 4:
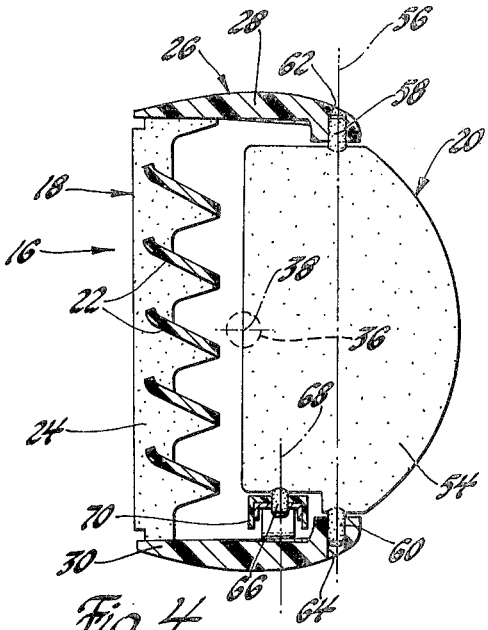
FIG. 4 is a cross section view taken in the direction of arrows 4—4 of FIG. 2, with parts removed, and particularly illustrating the louvered arrays.
Figure 5:
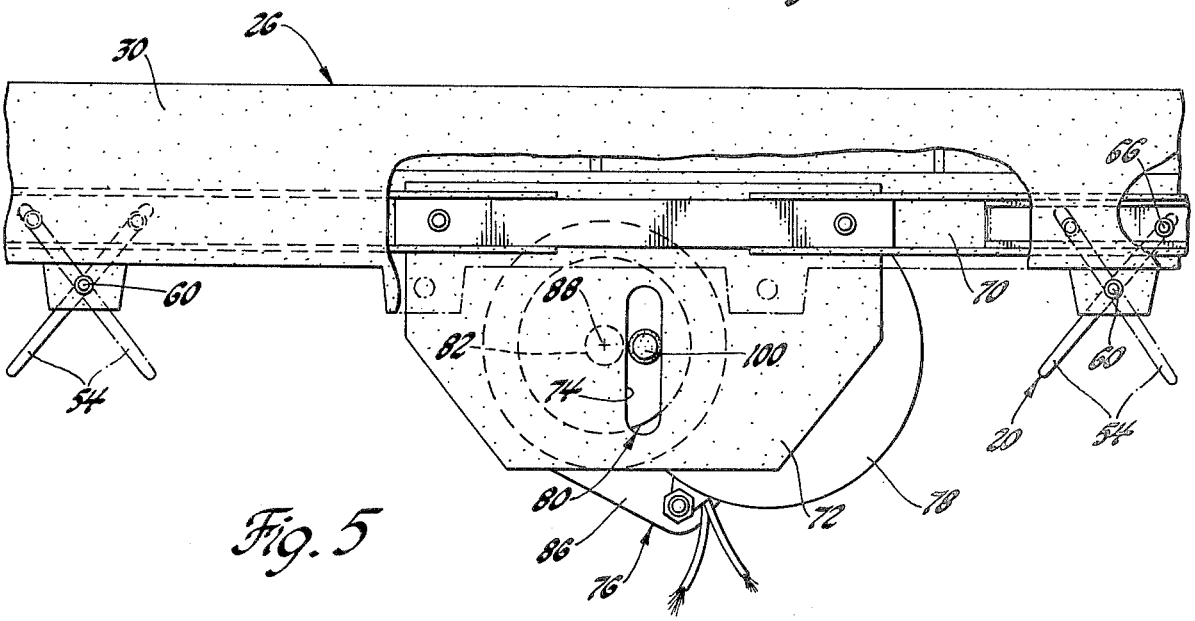
FIG. 5 is a plan view taken in the direction of arrows 5—5 of FIG. 1, with parts broken away, and illustrating by solid and phantom lines the pivotal action of a portion of the vertical louver array about vertical axes, and additional details of the mechanism embodying the invention.

The vertical louver array 20 is composed of a series of vertical louvers 54 mounted in rack 26 so that they pivot about vertical axes 56, these axes being parallel to each other and located in a single plane which is parallel to horizontal axis 38. As is better seen in FIG. 4, each vertical louver 54 is positioned upstream of the horizontal louver 22. Each louver 54 has an upper pivot 58 and a lower pivot 60 respectively received in openings 62 and 64 formed in rack top wall 28 and bottom wall 30, and a pivot 66 adjacent lower pivot 60. Pivot 66 has axis 68 passing therethrough axially parallel to but spaced from pivot axis 56. The bottom wall 30 of rack 26 has a tie bar 70 slidably mounted thereon and provided with pivot openings for each vertical louver 54 through which the vertical louver pivots 66 extend. Bar 70 is linearly movable toward and away from the rack end walls 32 and 34 in a manner to be described, driving the vertical louvers to pivot about their vertical axes 56 and therefore deflect air flow in a generally horizontal plane.

The drive mechanism for the tie bar includes a plate 72 which is secured to the center portion of the tie bar and extends toward air flow entry 44. The plate has a slot 74 formed therein. Slot 74 extends longitudinally parallel to the direction of air flow. A drive assembly 76 includes a drive motor 78 and a cam 80 mounted on the motor output shaft 82 to be rotated by the motor when the motor is energized. The motor illustrated is an electrical motor. Its housing is provided with a gear reduction mechanism so that the shaft 82 rotates at a relatively slow speed on the order of about one or two revolutions per minute. The motor is mounted by a suitable mounting means such as screws 84 and bracket 86 to the top wall 28 of the rack 26. The motor therefore moves pivotally about horizontal axis 38 when rack 26 is so pivotally moved since it is fixed to the rack.

Cam 80 is a barrel cam which rotates about the motor shaft axis 88 when the motor is driving the cam. The surface 90 of cam 80 is profiled so that, with the motor in position on rack 26, an arc 92 of the surface on the opposite side of the cam from horizontal axis 38 has as its center a point on axis 38. This is best envisioned by examining FIG. 3. The surface 90 has a slot or groove 94 which lies in a plane passing through axis 88 and other than perpendicular to that axis. The angle from the perpendicular to axis 88 that the plane in which groove 94 is formed determines the amount of rocking movement of the rack 26 and therefore the amount of vertical air sweep obtained by movement of horizontal louvers 22. A cam follower 96 includes a finger 98 which extends into the groove 94. Cam follower 96 is secured to the bottom wall 50 of the housing 40 and is preferably accessible by hand through entry 44 when the air flow guide mechanism 14 is removed. The cam follower is sufficiently flexible so that finger 98 may be lifted out of groove 94 when desired. This will eliminate the vertical air sweep movement of the horizontal louvers 22 when motor 78 is being operated while continuing the horizontal air sweep of vertical louvers 54.

Cam 80 has a pin 100 which is eccentrically mounted on the bottom portion of the cam and axially parallel to the cam axis 88. Pin 100 extends into slot 74 so that the opposite sides of the slot may be engaged by the pin in a cam follower arrangement. As the cam 80 rotates about axis 88, pin 100 moves in a circular orbit having a radius equal to the distance between the pin axis and axis 88. This movement causes the pin to slide in slot 74, thereby driving the plate 72 and tie bar 70 in a reciprocating action, causing pivotal movement of the louvers 54 about their axes 56, thereby generating horizontal air sweep.

In the preferred installation of the room air conditioning unit embodying the invention, the amount of vertical plane sweep action of the horizontal louvers, controlled by groove 94 and cam follower 96, is limited to an area above the normal height of human occupants in the room into which the air flow is delivered. When used in an office, for example, the lower portion of the vertical plane sweeping action would be above the heads of persons sitting near the air conditioning unit at a desk or other similar work areas. This will prevent a continuous draft of cooler air from being delivered directly to such persons, while effectively moving the air throughout the room. In some instances it may be desirable to mount the unit sufficiently high that persons standing while working in the room are also below the lower vertical air sweep limit. However, in typical installations this is usually not necessary since persons walking in the room are passing through an area and are not so continuously subject to a cooling air draft that they become uncomfortable or even unduly aware of air flow from the unit.

What is claimed is:

1. Air flow guide mechanism for guiding air flowing through an opening having top and bottom walls and end walls, said opening being adapted to deliver air flow into an enclosure commonly having one or more human occupants, said mechanism comprising:

a first louver array having first rack means pivotally mounted in said opening on a horizontal axis for pivotal movement in vertical planes and including a plurality of horizontally extending louvers, a second louver array mounted in said opening adjacent said first louver array in series air flow relation therewith and having a plurality of vertically extending louvers each pivotally mounted on a vertical axis for pivotal movement in horizontal planes, actuating rack means attached to said vertically extending louvers and movable to cause said vertically extending louvers to pivot about their vertical axes, a motor driven rotatable cam mounted on one of said rack means and having a first cam follower fixed to one of said opening walls and selectively engaging said cam whereby when said cam is rotated and said first cam follower is engaged in cam following relation with said cam, said cam and said first cam follower coact to cause said cam and said one of said rack means to pivotally oscillate the louvers associated therewith and cause a sweeping action of air flow in a first plane, said cam having a second cam follower attached to the other of said rack means whereby when said cam is rotated said cam and said second cam follower coact to drive the other of said rack means to cause pivotal oscillation of the louvers associated therewith and cause a sweeping action of air flow in another plane at substantially right angles to said first plane, said sweeping action combining to give a combination horizontal and vertical air flow sweep.

2. A louver mechanism for guiding air flow and obtaining vertical and horizontal air sweep actions, said mechanism comprising:

A louver array support pivotally mounted on a horizontal axis for pivotal movement in a vertical plane and including horizontally extending louvers forming a first louver array, a second louver array pivotally mounted on said louver array support adjacent said first louver array in series air flow relation therewith and having a plurality of vertically extending louvers each pivotally mounted on a vertical axis for pivotal movement in horizontal planes, actuating rack means attached to said vertically extending louvers and movable to cause said vertically extending louvers to pivot about their vertical axes, a motor driven rotatable cam mounted on said louver array support and having a first fixed cam follower engaging said cam whereby when said cam is rotated said cam and said first cam follower coact to cause said cam and said louver array support to pivotally oscillate said first louver array and cause a sweeping action of air flow in a generally vertical plane, said cam having a second cam follower attached to said actuating rack means whereby when said cam is rotated said cam and said second cam follower coact to drive the said actuating rack means to cause pivotal oscillation of the louvers of said second louver array and cause a sweeping action of air flow in a generally horizontal plane, said sweeping action combining to give a combination horizontal and vertical air flow sweep.

* * * * *

UNITED STATES PATENT AND TRADEMARK OFFICE

CERTIFICATE OF CORRECTION

PATENT NO. : 4,018,159

DATED : April 19, 1977

INVENTOR(S) : George T. Bennett

It is certified that error appears in the above-identified patent and that said Letters Patent are hereby corrected as shown below:

Column 1, line 32, "discharged" should read disengaged.

Signed and Sealed this ninth Day of August 1977

[SEAL]

Attest:

RUTH C. MASON
*Attesting Officer*

C. MARSHALL DANN
*Commissioner of Patents and Trademarks*